United States Patent [19]

Tistad

[11] Patent Number: 4,892,619

[45] Date of Patent: Jan. 9, 1990

[54] METHOD OF PRODUCTION OF FIBER CONTAINING PULP WITH DIFFERENT RAW MATERIALS

[75] Inventor: Goran Tistad, Karlstad, Sweden

[73] Assignee: Kamyr AB, Karlstad, Sweden

[21] Appl. No.: 177,472

[22] Filed: Apr. 1, 1988

[30] Foreign Application Priority Data

Apr. 6, 1987 [SE] Sweden ..... 87014239

[51] Int. Cl.[4] ..... D21F 7/06

[52] U.S. Cl. ..... 162/49; 162/55; 162/141; 162/149

[58] Field of Search ..... 162/19, 17, 82, 55, 162/141, 142, 149, 49

[56] References Cited

U.S. PATENT DOCUMENTS 4,342,618 8/1982 Karnis et al. ..... 162/55 X
4,502,918 3/1985 Mackie et al. ..... 162/55 X
4,543,181 9/1985 Greenwood .
4,680,108 7/1987 Ahs .

FOREIGN PATENT DOCUMENTS 0153717 2/1985 European Pat. Off. .

*Primary Examiner*—Peter Chin

*Assistant Examiner*—Thi Dang

*Attorney, Agent, or Firm*—Nixon & Vanderhye

[57] ABSTRACT

In continuous pulping processes for cellulosic fiberous material pulp, a changeover from deciduous wood raw material to coniferous wood raw material without interruption of the production process, and with a minimum waste of pulp, is provided. The pulp mixture during changeover, having a consistency of about 8–15% is fed to a screen in which the pulp is separated into two pulp fractions depending upon fiber length. A fiber length analyzer is placed in the pulp stream between a treatment or storage vessel and the screen, and controls the rejects line from the screen to determine the amount of pulp passing out the screen rejects conduit. The screen may be directly in a production line from a continuous digester, refiner, or like device for producing the pulp, or it may be connected to a storage vessel to which pulp from a digester or the like has been fed. The accepts conduit from the screen is connected to a first vessel while the rejects conduit is connected to a second vessel, with valves allowing for by-pass of the screen in feeding the pulp directly into either the first or second vessel when only a single type of pulp is being produced.

14 Claims, 1 Drawing Sheet

METHOD OF PRODUCTION OF FIBER CONTAINING PULP WITH DIFFERENT RAW MATERIALS

BACKGROUND AND SUMMARY OF THE INVENTION

During the production of cellulosic fibrous material pulp by continuous processes, such as the chemical or semi-chemical digestion of pulp in continuous digesters, or the production of mechanical pulp in refiners or the like, there are many circumstances in which it is desirable to change from a first raw material to a second raw material. For example it is very common to first be producing pulp from a coniferous wood (e.g. pine wood chips), and then switch over to the production of pulp from a deciduous wood (e.g. oak wood chips). If the production is stopped while changeover occurs so that there is no intermixing of the coniferous wood pulp and the deciduous wood pulp, the costs to the mill are substantial, therefore shutdowns are to be avoided. However during the changeover, a mixture of deciduous and coniferous pulps will be produced, which pulp mixture is not suitable for either of the end uses to which the coniferous or deciduous pulps are normally put. The pulp mixture may adversely influence the strength or other properties of the deciduous or coniferous pulps. The quantity of pulp mixture produced can be considerable in large production units. For example for a continuous digester that produces 1,000 tons of chemical pulp per day, the pulp mixture as a result of changeover of raw material can be about 40 to 50 tons.

According to the present invention it is possible to utilize the pulp mixture (e.g. the 40 to 50 tons in the example set forth above) in such a way that it will not be wasted, yet will not have an adverse affect on the properties of either the coniferous or deciduous wood pulps (for example). According to the present invention this is accomplished by terminating the feeding of the first pulp being produced by the production apparatus, and after changeover to the second material feeding the pulp mixture produced during the changeover to a screening station.

At the screening station, in the practice of the invention, the pulp mixture is separated into pulp fractions having properties corresponding to the first and second pulps, and the separated pulp fractions are fed to different locations for storage or treatment. Once the pulp mixture contains substantially all second pulp (that is after about 40–50 tons of pulp mixture has passed through, in the example set forth above), then the steps of feeding the pulp mixture to a screening station, and screening, are terminated, and all of the pulp is passed to a second treatment or storage vessel.

Typically the most significant different property of the first and second pulps is fiber length. The fiber length of the pulp mixture may be sensed prior to the screening station, and the proportion of pulp discharged from the screening station into either the first or second storage/treatment vessel is controlled in response to the fiber length analysis.

The screening station may be disposed directly in the discharge from the continuous treatment vessel (e.g. digester), or alternatively the pulp mixture can be fed to a storage vessel and fed from the storage vessel to the screening station. In this latter case, pumping and screening of the pulp mixture may take place over a longer period of time than it took to produce the pulp mixture.

The invention also comprises: A main vessel. At least three discharge conduits operatively connected to a discharge from the main vessel. Means for valving the flow of pulp from the main vessel so that it passes into one of the three discharge conduits. A first discharge conduit operatively connected to a first vessel. A second discharge conduit operatively connected to a pulp screen having an accepts discharge and rejects discharge. A third discharge conduit operatively connected to a second vessel. An analyzer for analyzing fiber length operatively connected to the conduits, and between the screen and the main vessel; and, the accepts discharge from the screen operatively connected to the first vessel, and the rejects discharge from the screen operatively connected to the second vessel.

It is particularly advantageous according to the invention that the continuous production of pulp, with minimum waste, can take place without diluting the pulp for conventional screening operations. By utilizing a screening apparatus that is capable of screening pulp having a consistency of between about 8–15% (the typical production consistency), it is possible to avoid the energy waste and the larger scale equipment that is necessary for diluting and then rethickening the pulp to screen it at low consistency.

It is the primary object of the present invention to provide an effective method for continuously producing cellulosic fiberous material pulp during changeover of a pulp production process from a first raw material to a second raw material so as to minimize the waste of the pulp while maintaining the integrity of the final pulp produced. This and other objects of the invention will become clear from an inspection of the detailed description of the invention and from the appended claims.

DETAILED DESCRIPTION OF THE DRAWING

Figure 1:
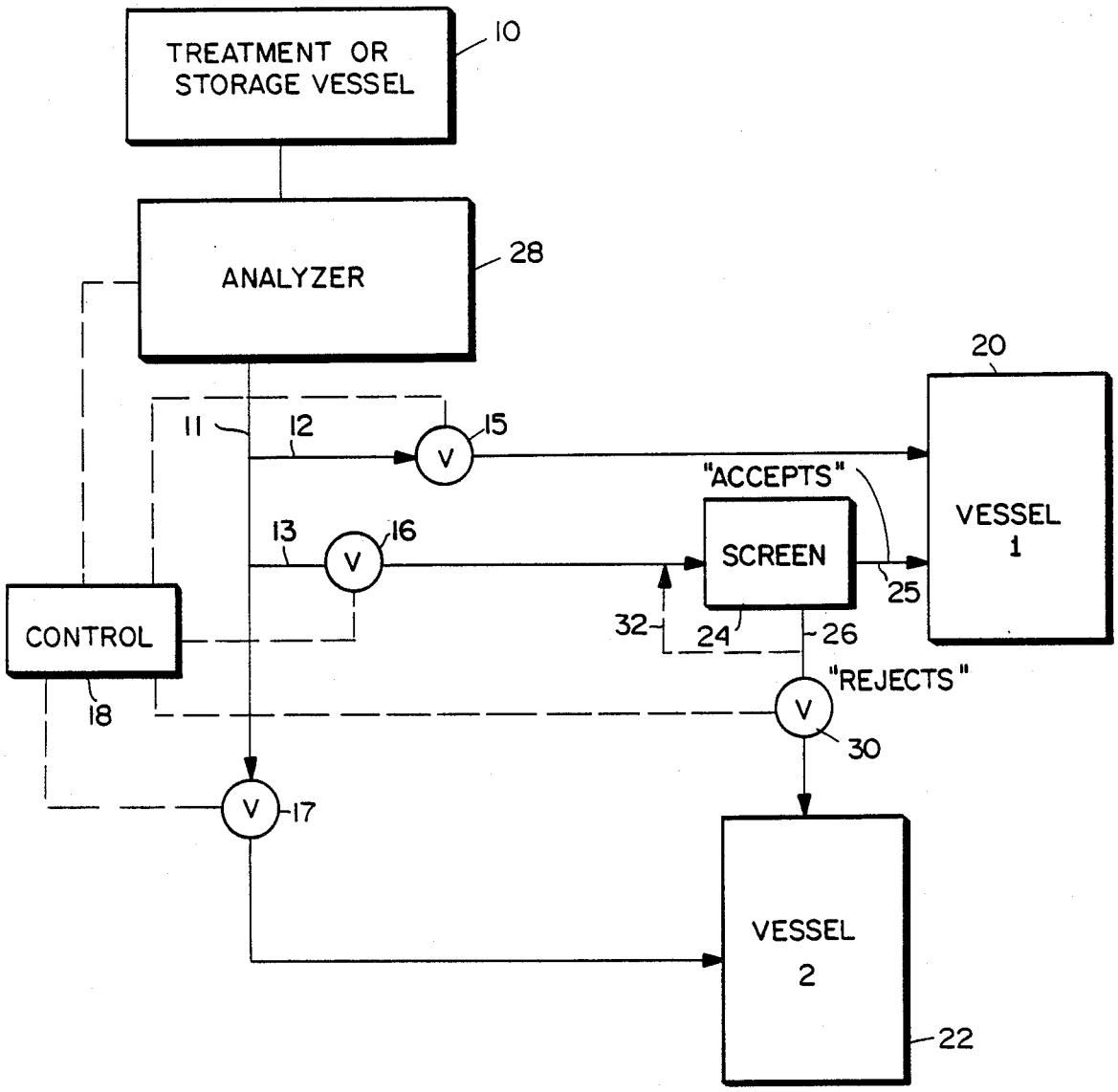
FIG. 1 schematically illustrates apparatus that may be utilized in the practice of the present invention.

A main vessel 10 may comprise either a treatment or storage vessel. For example it can be a continuous digester where a chemical pulp is being produced, a refiner where mechanical pulp is being produced, or a storage vessel operatively connected to a digester, refiner, or other pulp producing facility. A discharge line 11 extends from the main vessel 10, with first, second and third discharge conduits 12, 13, and 14, respectively, operatively connected to it. First, second, and third valve means 15, 16, and 17, respectively, are disposed in the conduits 12, 13, and 14. A control 18 is provided for controlling the valves 15, 16, 17, so that typically at any one time only one of the valves is open and the other two are closed.

The discharge conduit 12 is connected to a first vessel 20 for storage or subsequent treatment of a first pulp, while the third discharge conduit 14 is operatively connected to a second vessel 22 for storage or subsequent treatment of a second pulp, distinct from the first pulp. Throughout the main vessel 10, the discharge conduits 12 through 14, and the vessels 20 through 22, the pulp typically has a consistency of about 8–15% (e.g. about 10%).

During standard operation when a first raw material 10 is being used to produce pulp, the valves 16 and 17 are closed while valve 15 is open, with the pulp (first pulp) so produced flowing from the main vessel 10 directly to the vessel 20. For example during the production of pulp from deciduous wood, the produced pulp would flow directly from the main vessel 10 to the vessel 20.

When a second raw material is fed to the pulp production facility, such as coniferous wood chips, once a changeover of the pulp being discharged into line 11 (or once the vessel 10 is filled if it is a storage vessel) occurs, then the valves 15 and 17 are closed and the valve 16 is open. This pulp mixture, which is a mixture of a first pulp having the properties of the first raw material (e.g. deciduous wood), and a second pulp having properties of the second raw material (e.g. coniferous wood) is fed into conduit 13 and from there passes to a screening station at which a screen 24 is provided. The screen 24 is a screen capable of screening pulp at a consistency of about 8–15%, so that no dilution and rethickening is necessary. Such a screen may be of the type sold by Kamyr, Inc. of Glens Falls, N.Y. or Kamyr AB of Karlstad, Sweden under the trademark "MC", or may be of the type such as shown in U.S. Pat. Nos. 4,543,181 or 4,680,108. An "accepts" conduit 25 (or multiple conduits) from the screen 24 leads to the first vessel 20, while a "rejects" conduit 26 leads from the screen 24 to the vessel 22. The screen separates the pulp mixture fed into it into two fractions, one of which is fed to the vessel 20 (the first pulp), while the other is fed to the vessel 22 (the second pulp).

The first and second pulps of the pulp mixture typically have fiber length as a distinguishing property thereof. The screen 24 effects separation depending upon fiber length. Typically, a screen 24 could have a screen drum with slot widths in the range of 0.5–3 mm, and the slot widths may be provided so as to maximize effective separation of the pulp mixture into substantially pure first pulp, and substantially pure second pulp, streams. Also by controlling the pressure difference over the screen 24, and depending upon the type of pulp and the temperature, etc., the effectiveness of the screening operation may be varied.

Typically the power consumption of the screen 24, depending upon the exact pulp concentration, type, and production rate, would normally be in the range of about 8–14 kWh/ADMT.

The pulp mixture, over time, will have widely varying proportions of first and second pulp as the changeover takes place. For example initially the pulp mixture may have 10% short fibers and 90% long fibers, while toward the end of the changeover it will have 90% short fibers and 10% short fibers. This requires that the proportion of the accepts and rejects from the screen 24 be varied in proportion to the percentage of long or short fibers in the pulp mixture. This may be accomplished, according to the invention, by providing a fiber length analyzer in the conduit 13 just before the screen 24, and by providing a valve 30—ultimately controlled by the analyzer 28, through control device 18—in the rejects conduit 26. Alternatively the valve could be provided in one or more accepts conduits (e.g. U.S. Pat. No. 4,680,108 shows a screening device with a plurality of accepts conduits) extending from the screen 24 to the vessel 20.

The analyzer 28 may be any suitable device for sensing fiber length (or other distinguishing properties of the first and second pulps). As one example, it may comprise a Kajaani FS-100 fiber length analysis apparatus manufactured by Valmet Automation of Stockholm, Sweden. Other commercial fiber length analysis devices also are available. The analyzer 28 can sense when the valves 15–17 should be switched, under the control of device 18.

Eventually almost all of the pulp will become second pulp, after the pulp mixture has been flushed out of the production apparatus. When that occurs, either by automatic sensing thereof (e.g. with the analyzer 28), on the basis of the passage of a predetermined period of time, or otherwise, the control 18 can be actuated so that the valves 15 and 16 are closed and the valve 17 is open. Then all of the pulp will pass from the vessel 10 to the vessel 22, since it is substantially entirely composed of second pulp.

If desired, in order to enhance the efficiency of the screening operation, a portion of the pulp in the rejects conduit 26 may be recirculated—as indicated by line 32 in FIG. 1—to a point just prior to the screen 24.

If the vessel 10 comprises an intermediate storage vessel, instead of a production vessel (e.g. a continuous digester), then it is possible to effect the screening over a longer period of time than the time it takes to produce that pulp. For example if the entire pulp mixture discharged from the production vessel (e.g. continuous digester) is fed to a storage vessel (10), and after the mixed pulp has been exhausted the digester is switched over to a second storage vessel (e.g. the vessel 22), the pulp may be withdrawn from the storage vessel (10) by a pump or the like and passed to the screen 24 in a leisurely manner. This also minimizes the size of the screen 24 and like equipment that is necessary, yet effects a result that is advantageous.

Storage vessels utilized in the practice of the invention may be high consistency storage towers or medium consistency storage towers. In high consistency towers the pulp is typically stored at a concentration of 10 to 12% and is discharged by introducing dilution water to the bottom zone and pumping it out with a pump capable of handling only low concentration pulp. If a medium consistency tower is utilized, however, pulp having a consistency of 10 to 12% is pumped out utilizing a pump capable of pumping such pulp without dilution (e.g. a pump sold by Kamyr, Inc. of Glens Falls, N.Y. or Kamyr AB of Karlstad, Sweden under the trademark "MC").

Thus, according to one aspect of the present invention it is possible to continuously produce cellulosic fibrous material pulp during changeover of a pulp production process. For example a method may comprise the steps of: (a) Continuously feeding a pulp mixture having a consistency of between about 8–15% to a screening station. (b) Sensing the proportion of first pulp fiber length with respect to second pulp fiber length in the pulp mixture prior to feeding to the screening station. (c) At the screening station, separating the pulp mixture into separate pulp fractions according to the different pulp fiber lengths; and, (d) controlling the discharge of pulp from the screening station depending upon the results of the sensing in step (b).

As an alternative to the use of an analyzer 28 for controlling valve 30, if the pulp mixture from the production process is pumped to a storage tower, it can be mixed together in the tower with a mixer to provide a homogeneous pulp so that there is approximately a 50—50 concentration of short and long fibers. That homogeneous mixture may then be fed directly to a screen 24, with appropriately dimensioned slots, without the necessity for changing the amount of pulp passing out the rejects conduit 26, etc.

While the invention has been herein shown and described in what is presently conceived to be a practical and preferred embodiment thereof, it will be apparent to those of ordinary skill in the art that many modifications may be made thereof within the scope of the invention, which scope is to be accorded the broadest interpretation of the appended claims so as to encompass all equivalent methods and structures.

What is claimed is:

1. A method of continuously producing cellulosic fibrous material pulp during changeover of a pulp production process from a first raw material for continuously producing a first pulp having a first property, to a second raw material for continuously producing a second pulp having a second property different from the first property, so as to minimize waste of the pulp while maintaining the integrity of the final pulp produced, comprising the steps of continuously:

(a) feeding the continuously produced first pulp to a first location for storage or treatment thereof;

(b) after changeover to the second raw material, feeding the pulp mixture produced during changeover from the first to the second raw material, which pulp mixture has pulp with both said first and second properties, to a screening station;

(c) at the screening station separating the pulp mixture into separate pulp fractions according to the different first and second properties of the pulps making up the pulp mixture;

(d) feeding the separated pulp fractions, one fraction comprising substantially all first pulp and the other fraction substantially all second pulp, to different locations for storage or treatment of the first and second pulps; and (e) once the pulp mixture contains substantially all second pulp, terminating steps (b) and (c) and feeding the second pulp to a second location for storage or treatment thereof.

2. A method as recited in claim 1 wherein the different pulp properties are fiber length, and wherein step (c) is practiced so as to separate the pulp mixture into pulp fractions by fiber length.

3. A method as recited in claim 1 comprising the further step (f) of continuously varying the proportions of first and second pulp fractions discharged from the screening station in response to the proportions of first and second pulp in the pulp mixture.

4. A method as recited in claim 3 wherein step (f) is practiced by sensing the different first and/or second properties of the pulp mixture prior to its passage to the screening station, and controlling the discharge flow from the screening station in response to this sensing.

5. A method as recited in claim 4 wherein the different first and second properties of the first and second pulps, respectively, are fiber length, and wherein step (f) is practiced by sensing the fiber length.

6. A method as recited in claim 4 wherein the pulps and pulp mixture at all times have a consistency between about 8–15% during the practice of steps (a) through (f).

7. A method as recited in claim 1 wherein the first raw material is one of the materials selected from the group consisting of coniferous wood and deciduous wood, and the second raw material is the other of the materials selected from the group consisting of coniferous wood and deciduous wood.

8. A method as recited in claim 1 wherein step (c) is practiced by placing the screening station directly in a production line from a production vessel for producing pulp.

9. A method as recited in claim 1 wherein said pulp mixture is pumped from a storage vessel to the screening station of step (c).

10. A method as recited in claim 1 wherein step (b) is practiced by feeding the pulp mixture to a storage vessel, and wherein step (c) is practiced by withdrawing the pulp mixture from the storage vessel and then effecting screening thereof.

11. A method as recited in claim 10 wherein the pulps and pulp mixture at all times have a consistency between about 8–15% during the practice of steps (a) through (e).

12. A method as recited in claim 10 comprising the further step of mixing the pulp in the storage vessel so as to provide a completely homogeneous mixture.

13. A method as recited in claim 1 wherein the pulps and pulp mixture at all times have a consistency between about 8–15% during the practice of steps (a) through (e).

14. A method as recited in claim 1 practiced utilizing a treatment or storage vessel at each location for storage or treatment of pulp, and a screening station, with valves therebetween, and wherein the flow or passage of the pulp to the screening station and the flow or passage of the pulp fractions to the different locations are controlled by controlling valves.

* * * * *